United States Patent [19]

Palthe

[11] 4,018,240

[45] Apr. 19, 1977

[54] BRUSH CLEANING DEVICE

[76] Inventor: John W. Palthe, Roseville, Minn. 55113

[22] Filed: Apr. 28, 1975

[21] Appl. No.: 572,157

[52] U.S. Cl. ..... 134/196; 134/198; 15/38

[51] Int. Cl.[2] ..... B08B 3/02

[58] Field of Search ..... 134/191, 195–198, 134/201; 15/38

[56] References Cited

UNITED STATES PATENTS

| | | | |
|---|---|---|---|
| 631,960 | 8/1899 | Hawkes | 134/196 UX |
| 875,163 | 12/1907 | Ellis | 134/34 |
| 1,238,641 | 8/1917 | Coon | 134/201 |
| 2,490,765 | 12/1949 | Abbott | 134/201 X |
| 2,737,945 | 3/1956 | Nuss | 15/38 X |

*Primary Examiner*—Robert L. Bleutge
*Attorney, Agent, or Firm*—William L. Huebsch

[57] ABSTRACT

A device for use in thoroughly cleaning wet paint or varnish from a brush through the application of a cleaning solvent. The device includes a pump for pumping the solvent through a plurality of nozzles. The nozzles are adapted to be positioned between the bristles at the heel of a brush to be cleaned, with end portions of the nozzles in an opening between the bristles adjacent a divider wedge around which the bristles are fastened. Such positioning orients outlet openings adjacent the ends of the nozzles to direct solvent pumped through the nozzles transversely outwardly through the bristles to thoroughly clean the bristles at the heel of the brush.

10 Claims, 6 Drawing Figures

BRUSH CLEANING DEVICE

FIELD OF THE INVENTION

The present invention relates to devices for use in cleaning paint or varnish brushes with solvent.

BACKGROUND OF THE INVENTION

Heretofore the most common method for cleaning paint or varnish from a brush has comprised immersing the bristles of the brush in paint solvent (which solvent may be water or an organic paint solvent depending on the type of paint or varnish to be removed) and manually manipulating or wiping the bristles in an attempt to provide complete removal of the paint or varnish from between the bristles. Paint or varnish in the tip end portions of the bristles can be completely removed by this method. Despite conscientious attempts to clean a brush by this method, however, typically a small amount of the wet paint or varnish remains in the bristles at the heel of the brush adjacent where the bristles are attached to the handle of the brush, particularly (because of their inaccessibility) around the inner bristles. This paint or varnish will dry, and some may be released and deposited as foreign particles upon subsequent use of the brush. Also the paint or varnish remaining after each of a number of cleanings accumulates and adheres together the bristles at the heel of the brush decreasing the flexible length of the bristles and making the brush progressively less suitable for spreading paint or varnish until the brush may become totally unsuitable for use.

An article at pages 120–121 in the March, 1975 issue of the magazine entitled "Popular Science" dealt with the problem, of cleaning brushes and suggested pushing a comb or wire brush through the bristles of a brush to remove paint or varnish from adjacent its heel. This method of cleaning, however efficient, could cause a great deal of undesirable manual contact with the cleaning solvent, could damage the brush bristles, and could be more time consuming than may be desired.

SUMMARY OF THE PRESENT INVENTION

The present invention affords a quick, efficient and thorough removal of wet paint or varnish from the bristles of a brush, including thorough removal of wet paint or varnish from the bristles at the heel of the brush adjacent where the bristles are attached to the brush handle.

According to the present invention there is provided a device adapted for solvent cleaning a paint or varnish brush of the conventional type including an elongate divider wedge around which the bristles of the brush are attached and from which the bristles project to define a brush tip. The thickness and length of the divider wedge in such a brush causes an opening adjacent the wedge between walls of the bristles projecting from opposite sides of the wedge. The device according to the present invention has at least one and preferably two nozzles. Each nozzle is tubular with an end wall closing its terminal end and is adapted to have its terminal end inserted between the bristles of such a brush to a position with the end portion of the nozzles in the opening between the walls of bristles projecting from opposite sides of the divider wedge. The device also provides means adapted for pumping solvent through the nozzles, and each nozzle has radial outlet openings adjacent its closed terminal end positioned to direct solvent pumped through the nozzle transversely outwardly through the walls of bristles between which the nozzle is positioned to thoroughly remove paint from the bristles at the heel of the brush.

Preferably the nozzles have an axial length adapted to reach from the bristle tips to the divider wedge of a brush, are aligned with their axes in a common plane and their closed terminal ends projecting generally in the same direction, and have a thickness normal to said common plane slightly less than the thickness of the divider wedge. With this configuration the ends of the nozzles will fit freely in the opening between the walls of bristles projecting from opposite sides of the divider wedge with the ends of the nozzles against the divider wedge to afford easy positioning and proper alignment of the brush on the nozzles. Also a brush wider than the spacing between the closed ends of the nozzles can be easily moved laterally and will be guided by the ends of the nozzles sliding along the divider wedge and between the walls of bristles projecting from opposite sides of the divider wedge to afford full width cleaning of the brush.

Each nozzle is preferably cylindrical with a tapered end wall at its closed end so that it will slip easily between the bristles in the brush to a position with its closed end in the opening adjacent the divider wedge. Also, the outlet openings in each nozzle are preferably very closely spaced from the closed end of the nozzle so that the outlet openings can direct solvent through the bristles very close to the divider wedge, but the outlet openings are formed in the cylindrical side wall of the nozzle rather than in its tapered end wall to restrict engagement of bristles in the outlet openings when a brush is positioned over the nozzle.

In a preferred embodiment of the device, particularly suitable for use by the professional painter or home craftsman, the means for pumping the solvent is manually operable. The device is adapted to be attached in a solvent container with the outlet openings about at the solvent level and the ends of the nozzles projecting upwardly somewhat above the solvent level sufficiently so that a user can easily locate the nozzles prior to positioning a brush thereon, and so that solvent pumped through the outlet openings will flow transversely outwardly through the bristles and agitate solvent already around the bristles to wash paint or varnish away. Also with such a solvent level the bristle end portions of a brush positioned on the nozzles are immersed in the cleaning solvent so that paint or varnish therein will be washed away by agitation of the solvent being pumped and by flexure of the end portions of the bristles around the nozzles as the brush is moved into the solvent container and subsequently moved laterally across the nozzles to clean its entire width.

In this embodiment the means for pumping the solvent also includes means for directing solvent over the outer surface of the bristle portions above the solvent level to help agitate the solvent adjacent the brush and flush away paint or varnish washed from within the brush by solvent flowing transversely through the bristles from the nozzles.

BRIEF DESCRIPTION OF THE DRAWING

The device will be further described with reference to the accompanying drawing wherein like numbers refer to like parts in the several views and wherein.

DESCRIPTION OF THE PREFERRED EMBODIMENT

Figure 4:
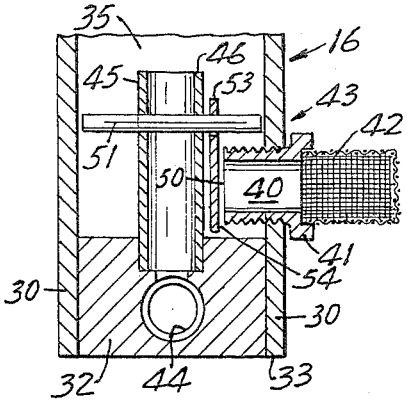
FIG. 4 is a fragmentary sectional view taken approximately along line 4—4 of FIG. 2.

Referring now to the drawing there is illustrated a device according to the present invention generally designated by the reference nuneral 10. The device 10 comprises a pair of long slender projecting nozzles 12 adapted to be positioned among the bristles 13 of a brush 14 (FIG. 1) and having outlet openings 15 adapted to direct cleaning solvent transversely outwardly through the bristles 13 to remove paint or varnish from the bristles; and a manually operable pump 16 coupled to the nozzles 12 and providing means for pumping solvent through the outlet openings 15 in the nozzles 12 from a source of solvent in a container 17 in which the device 10 is supported.

Figure 1:
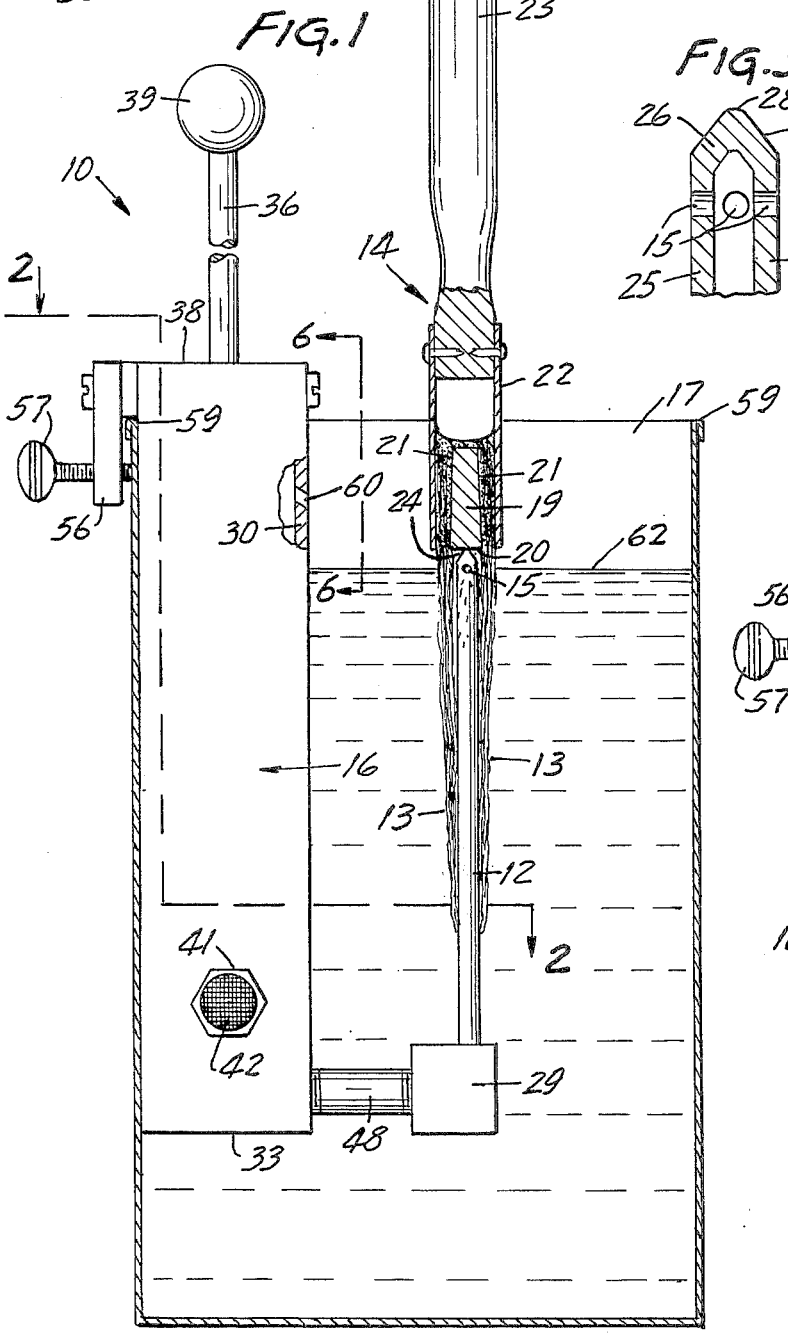
FIG. 1 is a vertical plan view illustrating a device according to the present invention mounted in a container of solvent, having a brush being cleaned supported on its nozzles, and having parts broken away and sectioned to show details.

The device 10 is adapted for cleaning brushes of a conventional type which, like the brush 14 illustrated in FIG. 1, each include an elongate divider wedge 19 with an elongate generally rectangular face surface 20 and generally parallel side surfaces 21 extending from the face surface 20 around which a multiplicity of the bristles 13 are adhered. The positions of the bristles 13 attached to the divider wedge 19 are enclosed by a metal ferrule 22 which couples the divider wedge 19 and bristles 13 to a brush handle 23. End portions of the bristles 13 form walls of the bristles projecting a generally uniform distance past the face surface 20 of the divider wedge 19 to define a tip portion of the brush adapted for applying paint or varnish. The thickness and length of the divider wedge 19 cause an opening 24 adjacent the divider wedge 19 defined by walls of the bristles projecting from opposite sides of the divider wedge 19, which opening 24 is tapered from the face surface 20 toward the tips of the bristles.

Figure 5:
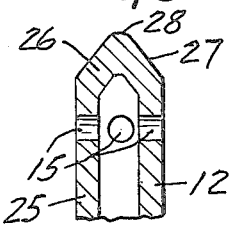
FIG. 5 is an enlarged fragmentary sectional view of an end of a nozzle of the device illustrated in FIG. 1.
Figure 3:
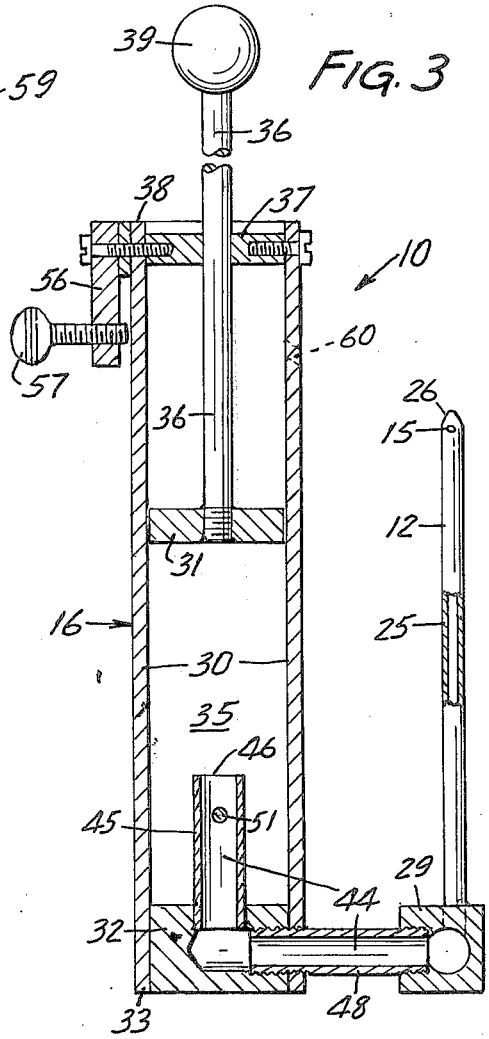
FIG. 3 is a reduced sectional view taken approximately along line 3—3 of FIG. 2.

The nozzles 12 each comprise a cylindrical tubular wall 25 defining a central opening closed at one end by an end wall 26 (as by spinning closed the end of the wall 25) defining a terminal end of the nozzle 12. Each nozzle 12 has a plurality of the spaced radially extending outlet openings 15 through the tubular wall 25 adjacent the end wall 26 communicating with the central opening and spaced at about 90° increments around the periphery of the nozzle 12 to direct solvent flow radially from the nozzles 12 and transversely through the bristles 13 of the brush 14 positioned over the nozzles 12. Each end wall 26 has a tapered outer surface 27 (FIG. 5) for separating bristles upon insertion of the nozzles 12, and a rounded smooth tip surface 28 affording relatively smooth sliding movement of the face surface 20 of the divider wedge 19 in the brush 14 along the nozzle tip surfaces 28.

The nozzles 12 each have an axial length adapted to reach from the tips of most conventional paint brushes to the divider wedge therein (e.g. over about 4⅜ inches) and are mounted on a manifold 29 with their axes parallel and in a common plane and their terminal ends projecting generally in the same direction. The nozzles have a thickness or outside diameter normal to the common plane through their axes which is adapted to be slightly less than the thickness of the divider wedge in most conventional paint brushes (e.g. about ¼ inch or less) so the ends of the nozzles 12 will fit freely in the opening between the walls of bristles projecting from opposite sides of the divider wedge in most brushes. The spacing between the nozzles 12 is selected to accommodate the smaller paint brushes (e.g. ¾ inch spacing which accommodates most conventional brushes of over about 2 inches in width) but yet provides proper guiding for wider brushes as they are slid transversely of the nozzles 12 to afford full width cleaning thereof. Smaller brushes may be cleaned by using only one of the nozzles 12.

The pump 16 comprises a tubular cylinder wall 30, which with a piston 31 and an end wall 32 at a first or bottom end 33 of the cylinder wall 30 defines a variable capacity pump chamber 35 (e.g. variable between about 2 inches and 6 inches long). A rod 36 is centrally attached to the piston 31, projects through and is guided in an opening in a guide wall 37 inset slightly from a second or top end 38 of the cylinder wall 30, and has a knob 39 attached to its projecting end adapted for manual engagement to afford manual reciprocation of the piston 31.

The pump 16 has an inlet opening 40 defined by an inlet tube 41 through the cylinder wall 30 and into which solvent may flow through a porous cylindrical metal filter 42. A check valve assembly 43 at the inlet opening 40 provides means for affording suction of solvent into the chamber 35 as the volume of the chamber 35 increases during movement of the piston 31 toward the top end 38 of the cylinder wall 30, and restricting solvent flow through the inlet opening 40 as the volume of the chamber 35 decreases during movement of the piston 31 toward the bottom end 33 of the cylinder wall 30. The pump 16 also has an outlet passageway 44 communicating with the central openings in the nozzles 12 defined by an outlet tube 45 having an end surface 46 which limits movement of the piston 31 toward the bottom end 33 of the cylinder wall 30, an opening through the end wall 32, a pipe nipple 48, and an opening in the manifold 29 capped at one end by a threaded plug 49. Reciprocal movement of the piston 31 will draw solvent into the pump chamber 35 through the inlet opening 40 and expel it through the nozzles 12. While a check valve could be provided at the outlet passageway 44 to restrict entrance of air through the nozzles 12 upon movement of the piston 31 toward the second end 38 of the cylinder wall 30, it has been found that such a check valve is not required to provide acceptable solvent pumping through the nozzles 12 apparently because in use most of the chamber 35 is below the solvent level in a container, and because the cross sectional areas of the central openings in the nozzles 12 are very small compared to the cross sectional area of the inlet opening 40.

Figure 2:
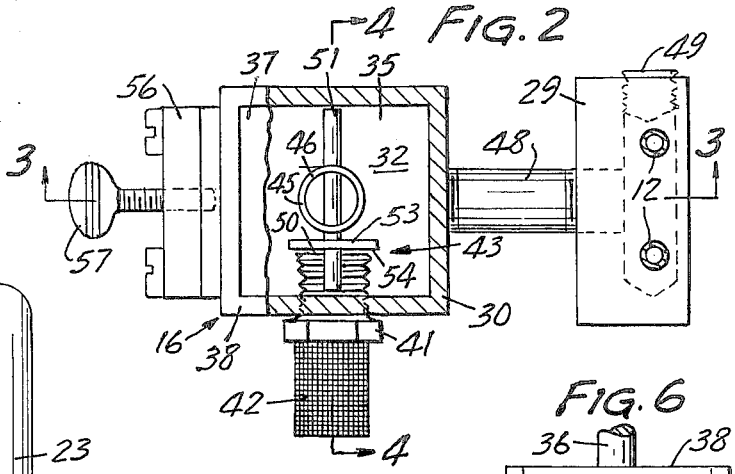
FIG. 2 is an enlarged sectional view taken approximately along line 2—2 of FIG. 1.
Figure 6:
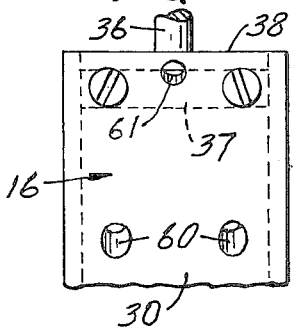
FIG. 6 is an enlarged fragmentary view taken approximately along the line 6—6 of FIG. 1.

The check valve assembly 43 at the inlet opening 40, seen in FIGS. 2 and 4, comprises a generally planar end surface 50 on the inlet tube 41 inside the cylinder wall 30, which end surface 50 is oriented generally parallel with the axis of the cylinder wall 30. A rod 51 extends transversely of the chamber 35 through the outlet tube 45 between the inside surfaces of the cylinder wall 30 on the side of the inlet tube 41 adjacent the top end 38 of the cylinder wall 30. The rod 51 is loosely received in an opening centered along one edge of a plate 53. The plate 53 has a planar contact surface 54 adapted to contact the planar end surface 50 of the inlet tube 41. When the pump 16 is positioned with the top end 38 of the cylinder wall 30 about vertically above its bottom end 33, the plate 53 hangs from the rod 51 with its contact surface 54 adjacent the end surface 50 of the inlet tube 41 and will swing to afford separation therebetween and flow of solvent into the pump chamber 35 upon movement of the piston 31 toward the top end 38 of the cylinder wall 30 to increase the volume of the chamber 35; and sealing engagement therebetween to force flow of solvent in the chamber 35 through the outlet passageway 44 upon subsequent movement of piston 31 toward the bottom end 33 of the cylinder wall 30 to decrease the volume of the chamber 35.

A downwardly extending L-shaped lip 56 secured at the top end 38 of the cylinder wall and a thumb screw 57 threadably engaged through the lip 56 provide means for engaging the device 10 with an upper lip 59 of the container 17 of solvent with the pump 16 inside the container 17 and the axis of the pump 16 oriented generally vertically. The pipe nipple 48 and manifold 29 provide means for supporting the nozzles 12 so that with this orientation of the pump 16 the nozzles 12 project upwardly axially parallel to the pump 16 with the end walls 26 of the nozzles adjacent the top end 38 of the cylinder wall 30.

Preferably the piston 31 does not fit closely within the cylinder wall 30, but has a slight peripheral clearance (e.g. 0.030 inch) which facilitates manufacture of the same. Since the area of the piston 31 (e.g. about 1½ square inch) is so great compared to this clearance, it will easily provide sufficient pressure to force solvent through the nozzles 12. Such clearance allows a certain amount of solvent to flow to the side of the piston 31 adjacent the top end 38 of the cylinder wall 30 as the piston 31 moves toward the bottom end 33 of the cylinder wall 30. Thus in addition to pumping solvent through the nozzles 12, the pump 16 acts as a lift pump upon movement of the piston 31 back toward the top end 38 of the cylinder wall, and will discharge the solvent on that side of the piston 31 through two outlet openings 60 in the cylinder wall 30. With the pump vertically oriented, as illustrated, the openings 60 are above the end walls 26 of the nozzles 12, and are oriented to direct such discharged solvent over the adjacent surface of a brush supported on the nozzles 12 and agitate the solvent in the container 17 adjacent thereto to help flush away paint particles washed through the bristles 13 by solvent pumped through the nozzles 12.

The cylinder wall 30 also has a drain opening 61 which allows drainage of solvent moved above the inset guide wall 37 by movement of the piston 31 and rod 36.

While the cross sectional shape of the cylinder wall 30 could be cylindrical, it preferably is rectangular or square (e.g. a standard size of extruded tubing such as ⅛ × 1½ × 1½ inch). Preferably the device 10 is made from non-sparking material, such as aluminum or brass, to restrict the danger of fire from the use of some solvents.

OPERATION

A user positions and fastens the device 10 in a container, such as the illustrated container 17 (which may be a two pound coffee can), by engaging the lip 56 on the pump 16 over the lip 59 of the container 17 and tightening the thumb screw 57; and fills the container 17 to about the line 62 indicated with an appropriate solvent. The user then positions a brush to be cleaned, (such as the brush 14) over the nozzles 12 with the tip surfaces 28 of the nozzles 12 against the face surface 20 of the divider wedge 19 in the brush 14. This position is fairly easily felt as the wall of bristles projecting past the face surface 20 from the side surfaces 21 of the divider wedge 19 tend to locate the nozzles 12 in the opening 24 therebetween. The user then grasps the knob 39 and reciprocates the piston 31 between the limits defined by the outlet tube 45 and guide wall 37 so that solvent is sucked through the inlet opening 40 past the check valve assembly 43 and forced out the outlet passageway 44 and through the outlet openings 15 in the nozzles 12 to wash paint particles transversely outwardly through the bristles 13 adjacent the divider wedge 19. Simultaneously, some of the solvent flows past the piston 31 as it moves toward the bottom end 33 of the cyliner wall 30 and upon subsequent movement of the piston 31 toward the top end 38 of the cylinder wall 30 is lifted and discharged through the openings 60 and over the adjacent outer surface of the bristles 13 to agitate the adjacent solvent in the container and help wash away particles flushed through the bristles 13 by solvent from the nozzles 12.

The user moves the brush 14 laterally with the face surface 20 of the divider wedge 19 and the walls of bristles around the end portions of the nozzles 12 guiding the brush 14 so that the entire width of the brush 14 is cleaned. During such movement the projecting ends of the bristles deflect around the nozzles 12 under the surface of the solvent, which deflection helps massage paint particles from the end portions of the bristles.

The user can then remove the brush 14, turn it 180°, return it to the nozzles 12 and repeat the above cleaning procedure to insure equal cleaning of both sides of the brush 14.

The cleaned brush is then removed from the nozzles 12 and solvent and allowed to dry.

I claim:

1. A device adapted for applying solvent to clean a paint or varnish brush of the conventional type having an elongate divider wedge and a multiplicity of bristles attached around the sides of said divider wedge and projecting a generally uniform predetermined distance in the same direction from the divider wedge to define a brush tip, the thickness and length of the divider wedge causing an elongate opening adjacent the wedge between walls of the bristles projecting from opposite sides of the wedge, said device comprising:

at least one nozzle comprising a tubular wall defining a central opening, having an open end, a closed terminal end opposite said open end, and a plurality of circumferentially spaced radial openings through said tubular wall communicating with said central opening and positioned closely adjacent said terminal end, said nozzle having a transverse thickness adjacent said terminal end adapted to afford insertion of the terminal end of said nozzle into the opening between the walls of bristles in a said brush; and means coupled to the open end of said nozzle adapted for passing a said solvent under pressure through the central opening and out through the radial outlet openings of the nozzle so that with the terminal end of said nozzle inserted in the opening between the walls of bristles of a said brush adjacent its divider wedge, solvent passing through the outlet openings of the nozzle will be directed transversely outwardly through the bristles of the brush adjacent its divider wedge to thoroughly clean the bristles.

2. A brush cleaning device according to claim 1 wherein said means for passing a said solvent comprises a tubular cylinder wall having a central passageway and first and second ends, a cylinder end wall closing said central passageway at the first end of said tubular cylinder wall, a piston slidably mounted in said central passageway for reciprocal motion between a position adjacent said first end and a position adjacent said second end, a rod attached to said piston projecting from the second end of said tubular cylinder wall and being adapted for manual engagement to afford manual reciprocal movement of said piston, said tubular cylinder wall, cylinder end wall and piston defining a pump chamber of variable volume, one of said cylinder walls having an inlet opening communicating with said chamber adjacent the first end of said tubular cylinder wall, and check valve means at said inlet opening for affording suction of solvent into said chamber during movement of said piston toward the second end of said tubular cylinder wall and restricting solvent flow through said inlet oening during movement of the piston toward the first end of said tubular cylinder wall; and said device includes means at the second end of said cylinder wall adapted to engage the upper lip of an open top container of said solvent with the first end of the cylinder wall extending into and generally vertically oriented within the container to position said inlet opening below the solvent in the container; and means between the first end of said tubular cylinder wall and the open end of said nozzle adapted for supporting the nozzle and having an outlet passageway communicating between said chamber and the central opening of said nozzle.

3. A brush cleaning device according to claim 2 wherein said check valve means comprises an inlet tube through said cylinder wall defining said inlet opening, said inlet tube having a planar end surface within said chamber oriented generally parallel with the axis of said tubular cylinder wall; a rod extending transversely of said chamber at the side of said inlet tube adjacent the seconsd end of said tubular cylinder wall; and a rigid plate having a planar contact surface adapted to contact the planar end surface of said inlet tube and having an orifice of larger diameter than said rod centered along the width of the plate at one edge of said contact surface, said rod passing through said orifice in said plate and being closely spaced from said inlet tube to hang said plate from said rod with said contact surface adjacent said end surface when the tubular cylinder wall is generally vertically oriented with its second end uppermost, thereby affording separation between said plate and inlet tube and flow of solvent into said chamber upon movement of said piston toward said second end of said tubular cylinder wall, and sealing engagement between said contact surface and end surface to cause flow of solvent through said outlet openings upon movement of said piston toward the first end of said tubular cylinder wall.

4. A brush cleaning device according to claim 2 wherein the tubular wall of said nozzle comprises a generally straight portion terminating at the terminal end of said nozzle, said straight portion having a length adapted to reach from the bristle tips to the divider wedge of a said brush and said means for supporting said nozzle positions the straight portion of said nozzle generally parallel with said tubular cylinder wall with the open end of said nozzle adjacent the first end of said tubular cylinder wall and the terminal end of said nozzle adjacent the second end of said tubular cylinder wall.

5. A brush cleaning device according to claim 4 wherein said nozzle is closely spaced from said tubular cylinder wall, said piston has a loose sliding fit in said tubular cylinder wall, and said tubular cylinder wall has relief ports adjacent the terminal end of said nozzle adapted, with the axes of said tubular cylinder wall and nozzle generally vertically disposed and the second end of said tubular cylinder wall uppermost, to direct solvent passing between the piston and cylinder wall upon movement of the piston toward the first end of said tubular cylinder wall over the adjacent outer surface of a said brush on said nozzle upon subsequent movement of the piston toward the second end of said tubular cylinder wall.

6. A brush cleaning device according to claim 1 wherein said device comprises a plurality of axially parallel nozzles with all of the nozzles on the device having their closed terminal ends generally aligned along a line extending in a direction normal to the axis of said nozzles and having their axes in a common plane, said transverse thickness of each of said nozzles being measured in a direction normal to said plane through the axis of said nozzles.

7. A brush cleaning device according to claim 1 wherein the outer surface of said nozzle is tapered at said terminal end to cause separation of the bristles of a said brush upon positioning of the brush over the nozzle, and the nozzle has a smooth terminal tip surface to allow sliding movement of the divider wedge of a said brush along the tip surface of the nozzle.

8. A brush cleaning device according to claim 1 wherein said means for passing a said solvent comprises a pump having an inlet and having an outlet coupled to the open end of said nozzle; and said device further includes clamping means adapted to engage the upper lip of an open top container of a said solvent for supporting said device on the container with said solvent at the inlet of said pump, and means supported by said clamping means adapted for supporting the straight tubular wall of said nozzle generally vertically upwardly with the terminal end of the nozzle uppermost within a said container to which said clamping means is engaged.

9. A device adapted for applying solvent to clean a paint or varnish brush of the conventional type having an elongate divider wedge and a multiplicity of bristles adhered around the sides of said divider wedge and projecting a generally uniform predetermined distance in the same direction from the divider wedge to define a brush tip, the thickness and length of the divider wedge causing an elongate opening adjacent the wedge between walls of the bristles projecting from opposite sides of the wedge, said device comprising:

two nozzles, each comprising a straight tubular wall defining a central opening, having a central axis, an open end, a closed terminal end opposite said open end, and a plurality of circumferentially spaced radial outlet openings through said tubular wall communicating with said central opening and positioned closely adjacent said terminal end, the outer surface of said nozzles being tapered at said terminal end to cause separation of the bristles of a said brush upon positioning of the brush over the nozzles and the nozzles having a smooth tip surface at said terminal end to allow sliding movement of the divider wedge along the tip surface of the nozzles;

means for pumping a said solvent through the central openings and radial outlet openings of said nozzles comprising a pump having an inlet and having an outlet coupled to the open ends of said nozzles;

clamping means adapted to engage the upper lip of an open top container of a said solvent for supporting said device on the container with the solvent at the inlet of said pump; and means supported by said clamping means for supporting the straight tubular walls of said nozzles generally vertically upwardly with the terminal ends of said nozzles uppermost within a said container with which said clamping means is engaged;

the axial length of said straight tubular walls of said nozzles being adapted to extend from the bristle tips to the divider wedge of a said brush and the thickness of said nozzles adjacent said terminal ends in a direction normal to a plane through the axis of said nozzles being adapted to be not substantially thicker than the divider wedge of a said brush so that a said brush can be positioned with the bristles around and generally parallel to the nozzles with the end walls of the nozzles adjacent the divider wedge in the opening adjacent thereto and said means for pumping solvent activated to direct solvent laterally outwardly through the bristles adjacent the divider wedge to thoroughly clean the bristles.

10. A brush cleaning device according to claim 9 wherein said pump comprises a tubular cylinder wall having a central passageway and first and second ends, a cylinder end wall closing said central passageway at the first end of said tubular cylinder wall, a piston slidably mounted in said central passageway for reciprocal motion between a position adjacent said first end and a position adjacent said second end, a rod attached to said piston projecting from the second end of said tubular cylinder wall and being adapted for manual engagement to afford manual reciprocal movement of said piston, said tubular cylinder wall, cylinder end wall and piston defining a pump chamber of variable volume, one of said cylinder walls having an inlet opening communicating with said chamber adjacent the first end of said tubular cylinder wall to provide said outlet, and check valve means at said inlet opening for affording suction of solvent into said chamber during movement of said piston toward the second end of said tubular cylinder wall and restricting solvent flow through said inlet opening during movement of the piston toward the first end of said tubular cylinder wall; said clamping means is at the second end of said cylinder wall and is adapted to position the cylinder wall generally vertically within the container with said inlet opening below the solvent in the container; and said means for supporting the straight tubular walls of said nozzles comprises said tubular cylinder wall and rigid means the first end of said tubular cylinder wall and the open end of said nozzles having an outlet passageway communicating between said chamber and the inlet opening of said nozzles, and positioning the open ends of said nozzles adjacent the first end of said tubular cylinder wall and the terminal ends of said nozzles adjacent the second end of said tubular cylinder wall.

* * * * *